US005683302A

United States Patent [19]

Harrell et al.

[11] Patent Number: 5,683,302

[45] Date of Patent: Nov. 4, 1997

[54] LASER BOWLING BALL GUIDING APPARATUS

[76] Inventors: John N. Harrell, 536 S. Phillips; Enoch Harris, 514 S. 9th, Apt. H, both of Salina, Kans. 67401

[21] Appl. No.: 801,954

[22] Filed: Feb. 18, 1997

[51] Int. Cl.[6] ..... A63D 5/00

[52] U.S. Cl. ..... 473/58

[58] Field of Search ..... 473/58; 372/9, 372/10, 15, 16; 362/811

[56] References Cited

U.S. PATENT DOCUMENTS

| | | | |
|---|---|---|---|
| 3,016,812 | 1/1962 | Chatlain | 95/11 |
| 3,252,705 | 5/1966 | Cornberg | 473/58 |
| 4,005,261 | 1/1977 | Sato et al. | 358/83 |
| 4,180,726 | 12/1979 | De Crescent | 250/222 R |
| 4,247,100 | 1/1981 | Barbee | 473/58 |
| 4,293,218 | 10/1981 | Nielsen et al. | 356/138 |
| 4,607,843 | 8/1986 | Signoretti | 473/58 |
| 4,822,040 | 4/1989 | Raditic | 473/58 |
| 4,893,182 | 1/1990 | Gautraud et al. | 358/105 |
| 5,118,105 | 6/1992 | Brim et al. | 273/54 C |
| 5,171,012 | 12/1992 | Dooley | 273/85 G |
| 5,342,041 | 8/1994 | Agulnek et al. | 273/1.5 A |

*Primary Examiner*—William M. Pierce

*Attorney, Agent, or Firm*—Flanagan & Flanagan

[57] ABSTRACT

A laser bowling ball guiding apparatus includes a projector, a laser beam emitted from the projector, and a diverging lens or at least one movable mirror for receiving the laser beam and projecting the laser beam onto a surface of a bowling alley and onto bowling pins so as to display a proper release point, trajectory and impact point for a bowling ball to follow. The apparatus can also employ a control mechanism connected to the projector for controlling transmitting of the laser beam. The projector is generally mounted to a ceiling or on a tripod. The control mechanism is adapted to receive an input of information and is operable to calculate the proper release point, trajectory and impact point for the bowling ball to follow. The diverging lens converts and projects the laser beam into the form of a line onto the surface of the bowling alley and onto the bowling pins. The movable mirror transmits the laser beam in the form of a dot and undergoes oscillatory and/or rotary movement to thereby cause a line to form on the surface of the bowling alley and on the bowling pins.

22 Claims, 2 Drawing Sheets

LASER BOWLING BALL GUIDING APPARATUS

BACKGROUND OF THE INVENTION

1. Field of the Invention

The present invention generally relates to devices for improving bowling skills and, more particularly, is concerned with a laser bowling ball guiding apparatus.

2. Description of the Prior Art

Bowling generally requires a participant to release a ball at a certain point and trajectory onto a surface of a bowling alley so as to impact bowling pins in a way which is most likely to result in knocking down the most pins, such as obtaining a strike, which involves knocking down all pins on a first ball, or a spare, which involves knocking down all remaining pins on a second ball. When participating in a league or tournament, the bowler must normally make these above-mentioned calculations on his or her own as part of the challenge of the game. During other times, however, the bowler may desire to practice with the assistance of an instructor.

While the presence of an instructor may be the most desirable way to improve the skills of a bowler, for one reason or another, an instructor may not be available to aid the bowler. A variety of devices have therefore been developed over the years to substitute for an instructor and/or to provide the instructor with an additional tool in teaching bowling skills to a student. Representative examples of these and like devices are disclosed in U.S. Pat. No. 3,016,812 to Chatlain, U.S. Pat. No. 3,252,705 to Cornberg, U.S. Pat. No. 4,247,100 to Barbee, U.S. Pat. No. 4,822,040 to Raditic, U.S. Pat. No. 4,893,182 to Gautraud et al. and U.S. Pat. No. 5,342,041 to Agulnek et al. These devices generally analyze motion, trace a ball moving along an alley and/or provide an image of the path of the ball, but do not appear to provide a guide for the bowler to use in delivering a bowling ball into bowling pins. The patent to Agulnek et al. discloses a guiding system which utilizes a laser beam to detect the position of a ball, provides information relating to the position to a processor, which uses this information and controls an illumination system to project a beam to illuminate the spot toward where the player should direct the ball, but is intended to be used for basketball and does not seem readily adaptable for use in bowling.

Consequently, a need still exists for a device which provides a solution to the aforementioned problem in the prior art without introducing any new problems in place thereof.

SUMMARY OF THE INVENTION

The present invention provides a laser bowling ball guiding apparatus designed to satisfy the aforementioned need. The laser bowling ball guiding apparatus of the present invention is adapted to provide a bowler with a guide for delivering a bowling ball into bowling pins. The laser bowling ball guiding apparatus is especially for determining and displaying a proper release point, trajectory and impact point for a bowling ball on a surface of a bowling alley and on the bowling pins.

Accordingly, the present invention is directed to a laser bowling ball guiding apparatus which comprises: (a) a projector; (b) a laser beam emitted from the projector; and (c) means for transmitting the laser beam from the projector onto a surface of a bowling alley and onto bowling pins so as to display a proper release point, trajectory and impact point for a bowling ball to follow. The apparatus can also include control means, such as a computer, connected to the projector and being operable for controlling the transmitting of the laser beam. The projector is generally mounted to a ceiling or on a tripod. The control means is adapted to receive an input of information and is operable to calculate the proper release point, trajectory and impact point for the bowling ball to follow.

The transmitting means can be either a diverging lens or at least one movable mirror. The diverging lens receives the laser beam and converts it into the form of a line onto the surface of the bowling alley and onto the bowling pins. The diverging lens has a focal length, a beam diameter and a spread angle. The spread angle is determined by the focal length and beam diameter.

The movable mirror receives the laser beam and converts it into the form of a dot and undergoes either oscillatory and/or rotary movement to thereby cause a line to form on the surface of the bowling alley and on the bowling pins. The movable mirror can have different forms. The movable mirror may be of any suitable type which oscillates and/or rotates in one dimension. The movable mirror may have multiple sides angularly displaced from one another. The movable mirror can be a galvometer or a pair of galvometers in which an electrical signal is used to drive the mechanical motion, such as oscillatory and/or rotary motion, of the mirror.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
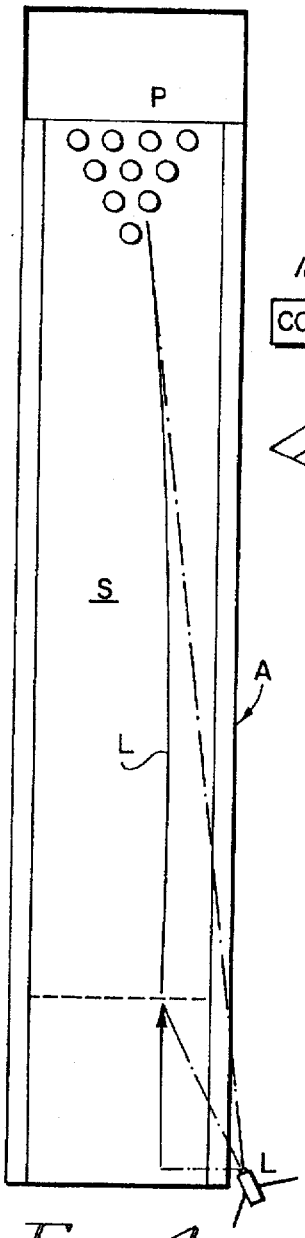
FIG. 1 is a diagrammatic top plan view of a projector and a laser beam of a laser bowling ball guiding apparatus of the present invention employed over a bowling alley and bowling pins.
Figure 2:
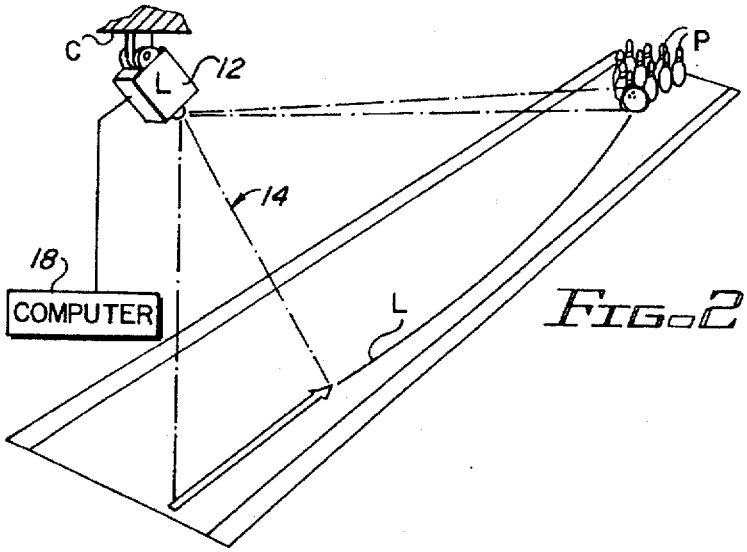
FIG. 2 is a diagrammatic perspective view of a projector, a laser beam and a computer controlling operation of transmission of the laser beam of the laser bowling ball guiding apparatus employed over a bowling alley and bowling pins.

Referring to the drawings and particularly to FIGS. 1 to 4, there is illustrated a laser bowling ball guiding apparatus, generally designated 10, of the present invention. Basically, the laser bowling ball guiding apparatus 10 includes a projector 12, a laser beam 14 emitted from the projector 12, and transmitting means 16 for projecting the laser beam 14 from the projector 12 onto a surface S of a bowling alley A and onto bowling pins P so as to display a proper release point, trajectory and impact point for a bowling ball to follow. The apparatus 10 also preferably, although not necessarily, includes control means, such as a personal computer 18 or the like, connected to the projector 12 and being operable for controlling transmitting of the laser beam 14. The projector 12 is mounted to a ceiling C, as shown particularly in FIGS. 2 and 3, or on a tripod T, as shown particularly in FIG. 4, and can be positioned for operation in any other suitable fashion. The projector 12 and laser beam 14 and computer 18 can be of any suitable conventional type well-known to those of ordinary skill in the art. The computer 18 can be readily programmed to receive an input of information and to calculate the proper release point, trajectory and impact point for the bowling ball to follow.

Figure 3:
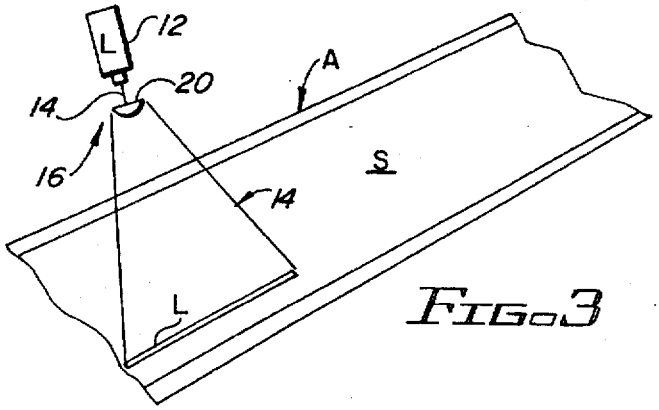
FIG. 3 is a diagrammatic perspective view of a projector, a laser beam and a diverging lens of the apparatus employed over a bowling alley.

Referring now particularly to FIG. 3, there is shown one embodiment of the apparatus 10 wherein the transmitting means 16 is a diverging lens 20 which receives the laser beam 14 from the projector 12 and converts or spreads the laser beam 14 in one dimension to form a line L onto the surface S of the bowling alley A and onto the bowling pins P. The diverging lens 20 has a desired focal length, a beam diameter and a spread angle. The spread angle is determined by the focal length and beam diameter. The diverging lens 20 can be mounted in any suitable fashion and location.

Referring now particularly to FIGS. 4 to 7, there is shown another embodiment of the apparatus 10 wherein the transmitting means 16 is at least one movable mirror 22 which receives the laser beam 14 from the projector 12 and converts the laser beam 14 into the form of a dot. Through either oscillatory and/or rotary movement, the movable mirror 22 causes the beam to rapidly move in the path of a line L formed on the surface S of the bowling alley A and on the bowling pins P. Human persistance of vision causes the appearance of a line as a result of the rapid repetitive motion of the beam.

Figure 4:
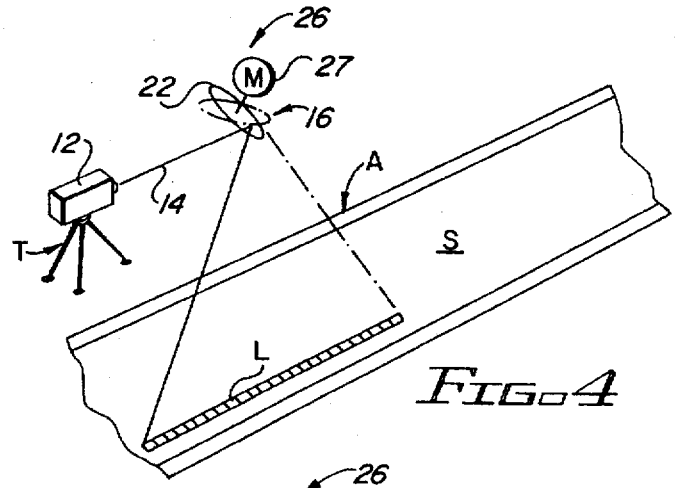
FIG. 4 is a diagrammatic perspective view of a projector, a laser beam and a movable mirror of the apparatus employed over a bowling alley.
Figure 5:
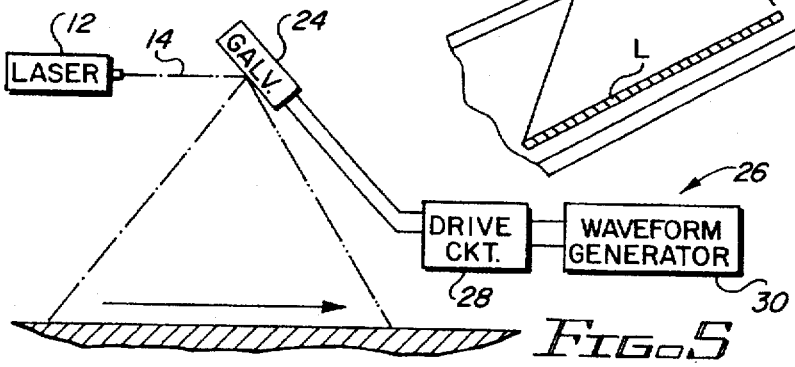
FIG. 5 is a diagrammatic side elevational view of a projector, a laser beam, a galvometer and a driving mechanism for causing oscillatory and/or rotary movement of the galvometer of the apparatus employed over a bowling alley.
Figure 6A:
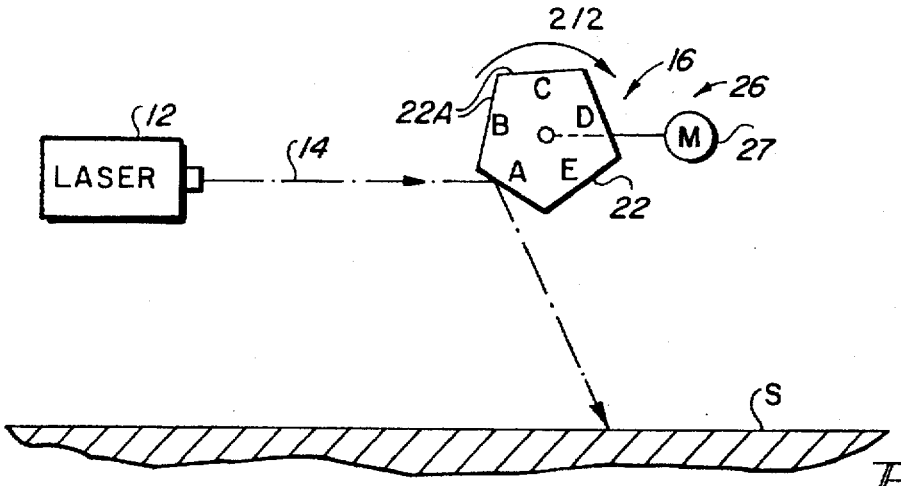
FIGS. 6A and 6B are diagrammatic side elevational views of a projector, a laser beam, a multi-sided movable mirror and a driving mechanism for causing oscillatory and/or rotary movement of the movable mirror of the apparatus employed over a bowling alley.
Figure 6B:
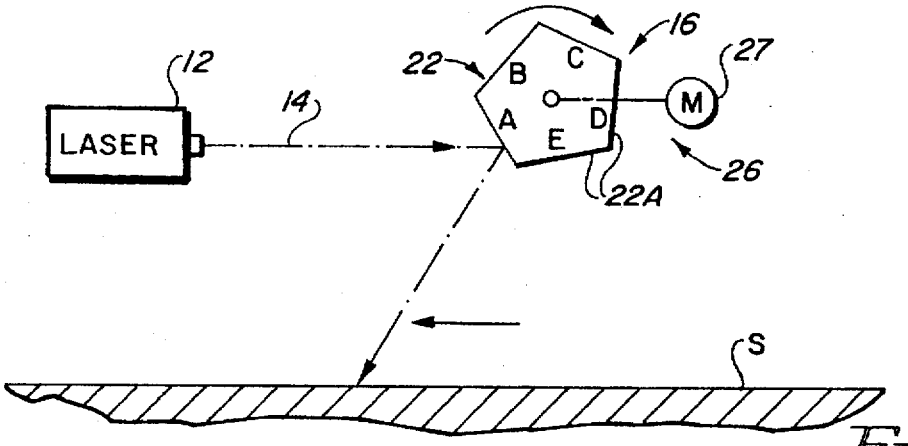
Figure 7:
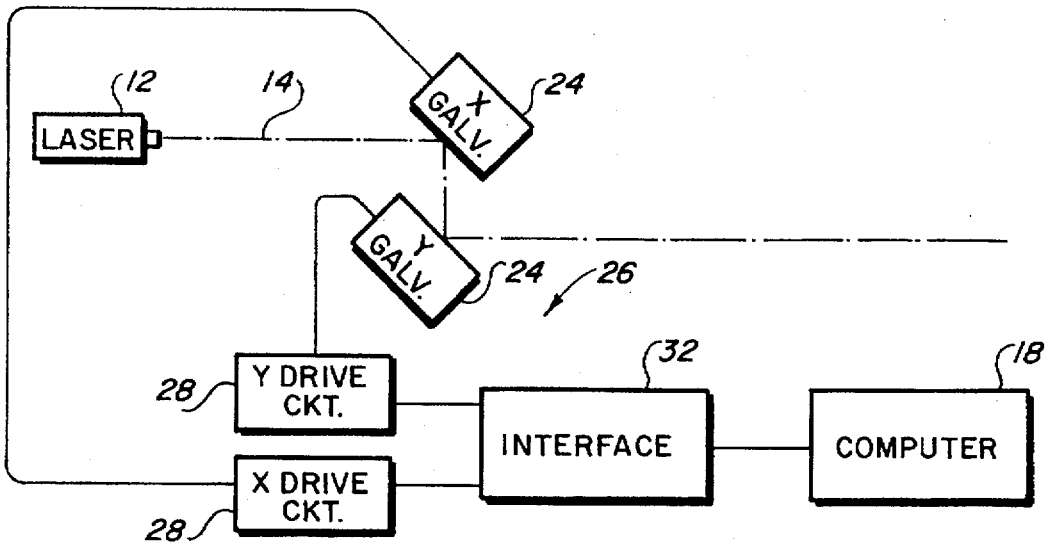
FIG. 7 is a diagrammatic side elevational view of a projector, a laser beam, a pair of galvometers and a driving mechanism for causing oscillatory and/or rotary movement of the galvometers of the apparatus employed over a bowling alley.

The movable mirror 22 may have different forms. The movable mirror 22 may be of any suitable type which rotates in one dimension, as shown in FIG. 4. In one form shown in FIGS. 6A and 6B, the movable mirror 22 has multiple sides 22A, such as five in number, being angular displaced from one another. In another form, the movable mirror 22 is a galvometer 24, as shown in FIG. 5, or a pair of galvometers 24, as shown in FIG. 7, in which an electrical signal is used to drive the mechanical motion, such as oscillatory and/or rotary motion, of the mirror 22. The movable mirror 22 can be mounted by any suitable means and in any suitable location.

Referring now particularly to FIGS. 1 to 8, the line L formed on the surface S of the bowling alley A and/or on the bowling pins P can be of a variety of shapes and sizes and can be provided for both left and right-handed bowlers. The line L may be linear or curved to show the proper release point and/or trajectory. The line L may also form a circle or the like on the bowling pins P to display the suggested impact point.

The apparatus 10 also includes a driving mechanism 26 for driving the oscillatory and/or rotary movement of the movable mirror 22. The driving mechanism 26 can be a conventional electric motor 27, as shown in FIGS. 4, 6A and 6B, or an electrical circuit 28, as shown in FIGS. 5 and 7, for energizing the desired movement of the movable mirror. The driving mechanism 26 is in operable communication with the movable mirror 22 and generates oscillatory and/or rotary movement of the movable mirror 22 in response to operation of the computer 18. A conventional waveform generator 30 may be used to direct operation of the electrical circuit 28, as shown in FIG. 5. More particularly, an output of sine, square and/or triangle wave oscillations can be applied to the electrical circuit 28 from the waveform generator 30 to cause oscillatory movement of the galvometer 24. A pair of the galvometers 24 may also be utilized, as shown in FIG. 7, in which case a pair of electrical circuits 28 are also employed and which are interfaced by interface 32 with the computer 18. Use of two galvometers 24 enables a two-axis, X and Y, arrangement allowing for X and Y movement of the laser beam 14, which permits a wide range of shapes and sizes of the line L.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A laser bowling ball guiding apparatus in combination with a bowling alley surface, comprising:

(a) a projector;

(b) a laser beam emitted from said projector; and (c) means for transmitting said laser beam from said projector onto the surface of a bowling alley so as to display a proper release point and trajectory and impact point for a bowling ball to follow.

2. The apparatus of claim 1 wherein said projector is mounted to a ceiling.

3. The apparatus of claim 1 wherein said projector is mounted on a tripod.

4. The apparatus of claim 1 wherein said transmitting means is a diverging lens for converting said laser beam into the form of a line onto the surface of the bowling alley and onto the bowling pins, said diverging lens having a focal length, a beam diameter and a spread angle, said spread angle being determined by said focal length and said beam diameter.

5. The apparatus of claim 1 wherein said transmitting means is at least one movable mirror for converting said laser beam into the form of a dot and for undergoing movement in a manner that that causes a line to form on the surface of the bowling alley and on the bowling pins.

6. The apparatus of claim 5 wherein said at least one movable mirror has multiple sides being angularly displaced from one another.

7. The apparatus of claim 5 further comprising:

a mechanism for driving said movement of said at least one movable mirror.

8. The apparatus of claim 7 wherein said driving mechanism is a motor.

9. The apparatus of claim 7 wherein said driving mechanism is an electrical circuit for energizing said movement of said movable mirror.

10. The apparatus of claim 1 further comprising:

a computer connected to said projector and being operable for controlling operation of said laser beam, said computer receiving an input of information and being operable to calculate a proper release point, trajectory and impact point for the bowling ball to follow.

11. A laser bowling ball guiding apparatus in combination with a bowling alley surface, comprising:

(a) a projector;

(b) a laser beam emitted from said projector;

(c) a diverging lens for receiving said laser beam from said projector and converting said laser beam into the form of a line onto the surface of a bowling alley so as to display a proper release point, trajectory and impact point for a bowling ball to follow, said diverging lens having a focal length, a beam diameter and a spread angle, said spread angle being determined by said focal length and said beam diameter; and (d) a computer connected to said projector and being operable for controlling transmitting of said laser beam.

12. The apparatus of claim 11 wherein said projector is mounted to a ceiling.

13. The apparatus of claim 11 wherein said projector is mounted on a tripod.

14. The apparatus of claim 11 wherein said computer receives an input of information and is operable to calculate the proper release point, trajectory and impact point for the bowling ball to follow.

15. A laser bowling ball guiding apparatus in combination with a bowling alley surface, comprising:

(a) a projector;

(b) a laser beam emitted from said projector;

(c) at least one movable mirror for receiving said laser beam from said projector and converting said laser beam into the form of a dot onto the surface of a bowling alley so as to display a proper release point, trajectory and impact point for a bowling ball to follow, said at least one movable mirror being adapted to undergo one of oscillatory and rotary movements to thereby cause a line to form on the surface of the bowling alley and on the bowling pins; and (d) a computer connected to said projector and being operable for controlling transmitting of said laser beam.

16. The apparatus of claim 15 wherein said projector is mounted to a ceiling.

17. The apparatus of claim 15 wherein said projector is mounted on a tripod.

18. The apparatus of claim 15 wherein said at least one movable mirror has multiple sides being angularly displaced from one another.

19. The apparatus of claim 15 further comprising: a mechanism for driving said one of said oscillatory and rotary movement of said at least one movable mirror.

20. The apparatus of claim 19 wherein said driving mechanism is a motor.

21. The apparatus of claim 19 wherein said driving mechanism is an electrical circuit for energizing said movement of said movable mirror.

22. The apparatus of claim 19 wherein said computer receives an input of information and is operable to calculate the proper release point, trajectory and impact point for the bowling ball to follow.

* * * * *